US006378256B1

(12) United States Patent
Gembala

(10) Patent No.: US 6,378,256 B1
(45) Date of Patent: Apr. 30, 2002

(54) WALL CLOSURE FOR ROOF SYSTEMS

(76) Inventor: Henry Gembala, 18108 Clearbrook Cir., Boca Raton, FL (US) 33498

( * ) Notice: Subject to any disclaimer, the term of this patent is extended or adjusted under 35 U.S.C. 154(b) by 0 days.

(21) Appl. No.: 09/694,725

(22) Filed: Oct. 23, 2000

Related U.S. Application Data

(62) Division of application No. 09/177,846, filed on Oct. 22, 1998, now Pat. No. 6,237,293.

(51) Int. Cl.[7] ..... E04A 12/00

(52) U.S. Cl. ..... 52/301; 52/53; 52/96; 52/713.04; 52/730.6; 52/731.7

(58) Field of Search ..... 52/53, 300, 303, 52/96, 301, 713.04, 302.1, 730.6, 730.1, 731.7

(56) References Cited

U.S. PATENT DOCUMENTS 3,862,531 A * 1/1975 Attaway et al. ..... 52/300
5,274,975 A * 1/1994 Haag ..... 52/300
5,277,002 A * 1/1994 Haag ..... 52/90.1
5,704,176 A * 1/1998 Greenberg ..... 52/300
6,223,489 B1 * 5/2001 Fisher ..... 52/308

* cited by examiner

*Primary Examiner*—Carl D. Friedman
*Assistant Examiner*—Yvonne M. Horton
(74) *Attorney, Agent, or Firm*—Robert M. Downey, P.A.

(57) ABSTRACT

A wall closure for use in conjunction with a roof system is defined by an integral unit fabricated from a non-corrosive, durable material and having a generally M-shaped configuration to provide an anchoring flange for attachment to the top of a vertical wall or parapet, an upper flange defining a mounting base for attachment of a wall coping, and an intermediate portion between the anchoring flange and the upper flange creating depth therebetween for ventilation of the roof system.

10 Claims, 1 Drawing Sheet

WALL CLOSURE FOR ROOF SYSTEMS

This application is a divisional patent application of patent application Ser. No. 09/177,846 filed on Oct. 22, 1998, now U.S. Pat. No. 6,237,293 B1 issued on May 05, 2001.

BACKGROUND OF THE INVENTION

1. Field of the Invention

The present invention relates to blocking for use in roof systems and, more particularly, to a roof blocking member for use as a wall closure and having a generally M-shaped cross-sectional configuration. The roof blocking member is formed as an integral unit from a non-corrosive, durable material, such as galvanized steel, steel, aluminum or plastic.

2. Description of the Related Art

Generally, roof systems used on most building structures, and particularly commercial buildings, require some type of blocking to provide a base for the attachment of roofing components such as, but not limited to, gravel stops, eves, drips, fascia, gutters, vent stacks, roof top equipment, expansion joints, roof curbs, copings and cant strips. Traditionally, wood is used for roof blocking and typically consists of one or more stacked wood boards (e.g., 2 inch by 4 inch or 2 inch by 6 inch boards) which are nailed to the roof structure and each other to provide a built-up base at various locations on the roof system wherein it is necessary to mount the roofing components and equipment. Presently, wood blocking is used on virtually all roof systems which require blocking for the purposes described above.

Despite its widespread use in roof systems, there are significant drawbacks and shortcomings associated with the use of conventional wood blocking. In particular, wood is susceptible to damage and deterioration from moisture, termites, ants, and other natural enemies. Further, because wood is a solid material, it does not provide for venting capabilities to permit escape of moisture and gasses from within the roof. The lack of adequate venting is a contributing factor of premature roof failure. Additionally, wood has limited pull-out characteristics for holding nails and other fasteners, thereby requiring a considerable amount of hardware to attach roofing components. Wood, being a natural product, is also prone to irregularities such as areas of reduced dimension, warping, and splintering. This makes it difficult, if not impossible, to achieve a straight, uniform blocking configuration. Furthermore, the dimensions of wood are limited to lumber industry standards which often does not correspond to the dimensions of roofing components, such as roof insulation or lightweight concrete thickness, expansion joint heights and equipment sizes.

In view of the shortcomings of traditional wood blocking used in roof systems, as set forth above, there exists an urgent need in the construction industry for an alternative blocking structure which overcomes the above-described problems. More specifically, there is a need for a blocking assembly which provides for uniform dimensions in accordance with desired size and configuration specifications and which further provides for venting of the roof system. Additionally, there is a need for a roof blocking system which significantly reduces costs for labor and materials associated with the installation of blocking and the attached roofing components.

SUMMARY OF THE INVENTION

The present invention is directed to a blocking assembly for roof systems and replaces traditional wood blocking which is currently used on building structures to facilitate the attachment of various roofing components, materials and equipment including, but not limited to copings and cant strips.

The blocking assembly provides a wall closure for installation to the top end of a vertical wall on a roof structure. The wall closure is structured as an integral unit having a generally M-shaped configuration and is fabricated from galvanized steel, steel, aluminum, plastic or other non-corrosive, durable materials. The M-shaped configuration provides an anchoring flange, an upper flange and intermediate portion. The anchoring flange is structured and a disposed for mating attachment to the top end of the vertical wall or parapet on the roof structure. The intermediate portion extends upwardly from the anchoring flange to the upper flange, forming a gap or area of depth to provide means for ventilation of the roof structure at the vertical wall or parapet, thereby allowing escape of moisture and gasses which otherwise remain trapped within the roof system. This helps to reduce the likelihood of premature roof failure, and thereby extends the life of the roof system. The upper flange extends from the intermediate portion and defines a mounting base for attachment of a wall coping.

OBJECTS AND ADVANTAGES OF THE INVENTION

With the foregoing in mind, the present invention has the following objects and advantages over the conventional wood blocking structure presently used in most roof systems.

In particularly, a primary object of the present invention is to provide a blocking assembly for roof systems comprising one or more pre-formed components manufactured from galvanized steel, steel, aluminum, plastic or other corrosion-resistant materials to thereby provide resistance to deterioration from moisture, insects, warping, and the like.

It is a further object of the present invention to provide a blocking assembly comprising one or more components which are formed and/or molded in accordance with desired size and configuration specifications for use at specific locations of a roof system.

It is still a further object of the present invention to provide a blocking assembly having a pullout resistance which is significantly greater than that of wood, thereby requiring less hardware, labor and materials to install the blocking and attached roofing materials.

It is yet a further object of the present invention to provide a blocking assembly having pre-punched fastener holes to thereby alleviate human error during installation.

It is still a further object of the present invention to provide a blocking assembly for roof systems which, once installed, becomes integrated with the roof structure.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
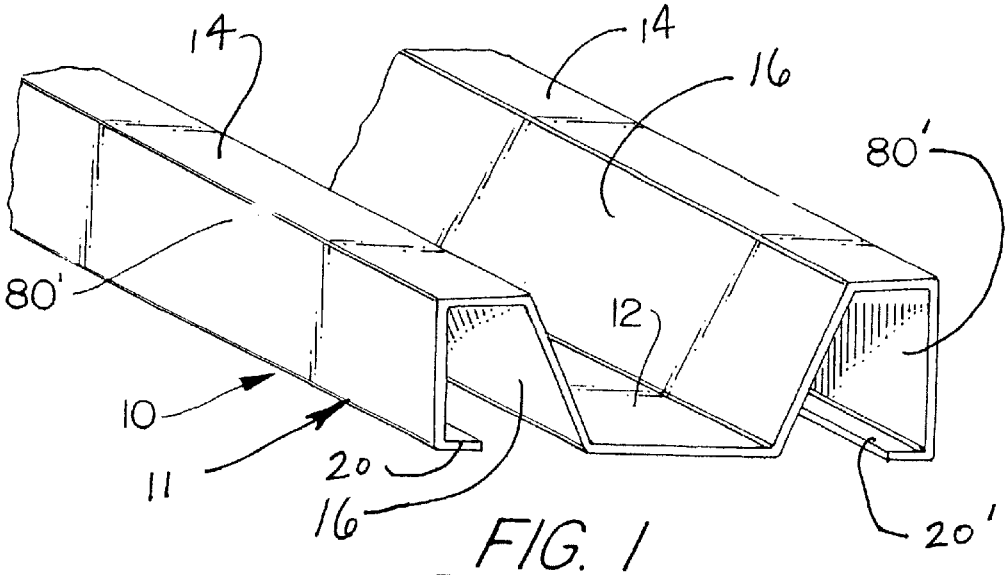
FIG. 1 is a partial perspective view of the wall closure of the present invention.
Figure 2:
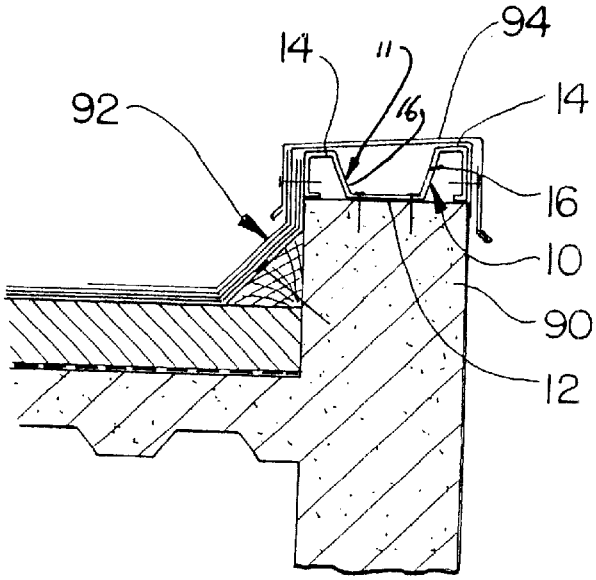
FIG. 2 is a sectional view showing the wall closure of FIG. 1 installed to a concrete parapet on a roof system for attachment of a parapet coping, flashing strip, and steel cleats thereto.

FIGS. 1 and 2 illustrate a preferred embodiment of the blocking assembly 10. The blocking assembly 10 is particularly structured to provide a wall closure 11 for installation to the top of a vertical wall on a roof structure. In this particular embodiment, the wall closure has a generally M-shaped cross-sectional configuration and includes an anchoring flange 12 disposed between opposite rails 20, 20'. The anchoring flange 12 and opposite rails 20, 20' extend along a common plane and mate against an underlying surface to which the wall closure is anchored. Intermediate panel portions 16 extend upwardly from the anchoring flange 12 at an angle to respective upper flanges 14. The upper flanges 14 extend between the respective intermediate panel portions 16 and each of the parallel sides 80, 80', as seen in FIGS. 1 and 2. This particular embodiment of the blocking assembly 10 is suited for attachment to the top surface of a concrete parapet 90 to facilitate attachment of various roofing materials including a base flashing strip 92 and parapet coping 94.

It should be noted that the blocking assembly 10, and particularly the wall closure 11, is formed as an integral unit from galvanized steel, steel, aluminum, plastic or other non-corrosive, durable materials. The integral unit may be formed by various forming and molding methods well known in the industry including bending, roll forming, extrusion molding, injection molding and vacuum molding.

While the instant invention has been shown and described in accordance with a preferred and practical embodiment thereof, it is recognized that departures may be made from the instant disclosure which, therefore, should not be limited except as set forth in the following claims as interpreted under the doctrine of equivalents.

What is claimed is:

1. A blocking assembly for attaching a coping to the top of a vertical wall of a roof structure of a building, wherein the vertical wall includes a top flat surface; said blocking assembly comprising:

an integral, one-piece elongate unit having an M-shaped cross-sectional configuration and comprising:

an anchoring flange structured and disposed for mating engagement and attachment to the top flat surface of the vertical wall of the roof structure;

first and second upper flanges defining a mounting base for mating engagement with the coping;

intermediate portions extending between said anchoring flange and said first and second upper flanges, respectively;

opposite rails disposed in co-planer, spaced relation to said anchoring flange, on opposite sides thereof, said rails being structured and disposed for mating engagement with the top flat surface of the vertical wall; and opposite side wall portions extending in perpendicular relation between said respective opposite rails and said respective first and second upper flanges.

2. The blocking assembly as recited in claim 1 wherein said integral unit is formed of galvanized steel.

3. The blocking assembly as recited in claim 1 wherein said integral unit is formed of steel.

4. The blocking assembly as recited in claim 1 wherein said integral unit is formed of aluminum.

5. The blocking assembly as recited in claim 1 wherein said integral unit is formed of plastic.

6. A blocking assembly for attaching a coping to the top of a vertical wall of a roof structure of a building, wherein the vertical wall includes a top flat surface; said blocking assembly comprising:

an integral one-piece elongate unit having an M-shaped cross-sectional configuration and comprising:

an anchoring flange structured and disposed for mating engagement and attachment to the top flat surface of the vertical wall of the roof structure;

opposite rails disposed in co-planer, spaced relation to said anchoring flange, on opposite sides thereof, said rails being structured and disposed for mating engagement with the top flat surface of the vertical wall; and opposite side wall portions extending upwardly from said opposite rails, respectively.

7. The blocking assembly as recited in claim 6 wherein said integral unit is formed of galvanized steel.

8. The blocking assembly as recited in claim 6 wherein said integral unit is formed of steel.

9. The blocking assembly as recited in claim 6 wherein said integral unit is formed of aluminum.

10. The blocking assembly as recited in claim 6 wherein said integral unit is formed of plastic.

* * * * *